United States Patent [19]

Haug

[11] Patent Number: 4,934,011

[45] Date of Patent: Jun. 19, 1990

[54] LOTION APPLICATOR

[76] Inventor: Christopher B. Haug, 649 Bolsana Dr., Laguna Beach, Calif. 92651

[21] Appl. No.: 338,586

[22] Filed: Apr. 17, 1989

[51] Int. Cl.[5] ..... A47K 7/02; A47L 13/46; B43L 21/00

[52] U.S. Cl. ..... 15/145; 15/244.1; 401/25; 401/6

[58] Field of Search ..... 401/23, 25, 6; 15/145, 15/244.1, 244.4, 244.3; 128/DIG. 15

[56] References Cited

U.S. PATENT DOCUMENTS

| | | | |
|---|---|---|---|
| 2,491,274 | 12/1974 | McNeill | 15/244.1 |
| 3,059,262 | 10/1962 | Marschner | 15/145 X |
| 3,103,682 | 9/1963 | Markel | 401/6 |
| 3,105,263 | 10/1963 | Ginter | 15/244.1 |
| 3,134,124 | 5/1964 | Horn | 15/244.1 |
| 3,876,314 | 4/1975 | Nehring | 401/133 |
| 4,155,139 | 5/1979 | Corcoran | 15/244.1 |

FOREIGN PATENT DOCUMENTS

| | | | |
|---|---|---|---|
| 507633 | 9/1930 | Fed. Rep. of Germany | 15/244 |

*Primary Examiner*—Richard J. Johnson
*Attorney, Agent, or Firm*—Francis X. LoJacono

[57] ABSTRACT

A liquid applicator device that is particularly designed for the application of sun tan lotion and the like over one's body, wherein the applicator device consists of an elongated handle having a head or paddle member located at one end of the handle so as to be received in an applicator pad. The applicator pad includes an internal cavity adapted to receive the head member of the handle in a removably secure manner whereby the applicator pad is prevented from being removed from the handle inadvertently while applying lotion to one's body, but yet can be removed manually when required for cleaning or when replacing of the pad, as required.

7 Claims, 1 Drawing Sheet

LOTION APPLICATOR

BACKGROUND OF THE INVENTION

1. Field of the Invention

The present invention relates generally to a lotion applicator and more particularly to an applicator that is suitable for applying sun screen lotions and the like wherein the applicator inclueded a soft applicator pad removably mounted to one end of an applicator handle.

b 2. Description of the Prior Art

As is well known in the art, various problems and difficulties are encountered in providing suitable means for applying lotions to all parts of one's body.

Many types of applicators have been tried and suggested. However, these devices have various limitations that restrict their use and are unsuitable for applying sun tan lotions and the like. Moreover, some types of applicators are complicated to operate and expensive to maintain. As examples of some known applicators one may refer to any of the following U.S. Patents.

There is disclosed in U.S. Pat. No. 3,568,237 to W. L. Rhodes a sponge back washer which consists of a rectangular base having upstanding flanges on each edge. The flanges on the long edges also then extend inwardly into cooperative slits on a cellulose sponge member located on the base member between the upstanding flanges. The holder is further provided with an elongated curved handle which is pivotally attached to the handle which is pivotally attached to the base member. Such a unit as this does not seem suitable for applying sun tan lotions.

In U.S. Pat. No. 3,699,980 to D. D. Carpenter there is disclosed an elongated applicator pad secured permanently or detachably to one surface of the belt. The belt and pad are arranged to be rolled up and are provided with a means for detachably holding the belt and pad in a rolled-up position.

The applicator as shown in U.S. Pat. No. 4,299,005 to H. B. Brown includes an elongated handle pivotally connected to a head pad housing in which an absorbent pad is mounted therein. The handle has telescoping sections extensible to various lengths and an eccentric lock that secures the telescoped sections in a fixed position.

In U.S. Pat. No. 4,483,356 to D. R. Kales there is disclosed a hand-held lotion applicator having an adjustable handle into which is inserted a flexible bale with a pad attached to the bale. The pad adjustably swivels on the handle so that the flattened pad remains in uniform contact with the user's skin.

T. K. Meyer is his U.S. Pat. No. 4,483,636 discloses a liquid applicator that includes a deformable elongate tubular member which defines a cavity for storage of liquid. The liquid is applied through the distal end of the tubular member which is provided with a dispensing head that is adjustably attached thereto. The dispensing head includes a flat application surface, which is covered by a compressible porous pad. The porous pad is adapted to be replaceable.

OBJECTS AND ADVANTAGES OF THE INVENTION

It is an object of the present invention to provide a sun tan lotion applicator which comprises a elongated handle having the proximate end thereof formed with an enlarged head or paddle member on which is removably mounted an absorbent pad. The abosrbent pad includes means by which the pad can be sufficiently secured to the head member so as not to separate from the handle when the applicator is being used to apply lotion over one's body.

Another object of the invention is to provide an absorbent foam pad having a cavity defined therein to receive the head or paddle member of the handle. The open portion of the pad member is provided with a suitable keeper or securing means that prevents the pad from being disloged during use, but can be readily removed for cleaning or mounting a replacment pad thereon. Securing fabric material, such as "Velcro", a trademarked securing material is contemplated for use in one arrangement of the invention.

A further object of the invention is to provide an applicator that is suitable for applying sun tan lotion, although it can be used for many other applications. Thus, the handle has a length that can easily reach any part of one's body without such as when the user thereof is applying lotion to his or her own back areas which are normally difficult to reach without the present invention.

A still further object of the present invention is to provide a device of this character wherein the handle thereof is made from a suitable high-impact plastic in several desirable color and together with the pad member is still a very lightweight unit.

It is still another object of the present invention to provide an applicator of this character having no moving parts which makes it easy to use, service and maintain.

It is still a further object of the invention to provide a device of this character that is realtively inexpensive to manufacture and is simple but rugged in construction.

SUMMARY OF THE INVENTION

The present invention consists of a high-impact plastic handle on which a liquid-absorbing foam pad that is readily treated with lotions or more particulary sun tan lotion. A handle is adapted to support the pad so it can be readily removable, with the pad being formed in a somewhat square or rectangular configuration that includes a tapered leading upper edge and a slot formed in the lower edge of the pad. The slot allows the head or paddle portion of the handle to be inserted and received in a cavity defined within the pad. This allows the pad to be removed at any time so that a clean or new pad can be positioned over the paddle end of the handle.

Various means can be used to removably mount a pad to the handle, depending on the particular configuration of the pad structure.

The characteristics and advantages of the invention are further sufficiently referred to in connection with the accompanying drawings, which represent one embodiment, variations may be made without departing from the principles disclosed and I contemplate the employment of any structures, arrangements of modes of operation the are properly within the scope of the appended claims.

BRIEF DESCRIPTION OF THE DRAWING FIGURES

With the above and related objects in view, the invention consists in the details of construction and combination of parts, as will be more fully understood from the following description, when read in conjunction with the accompanying drawings and numbered parts, in which.

DETAILED DESCRIPTION OF THE INVENTION

Figure 1:
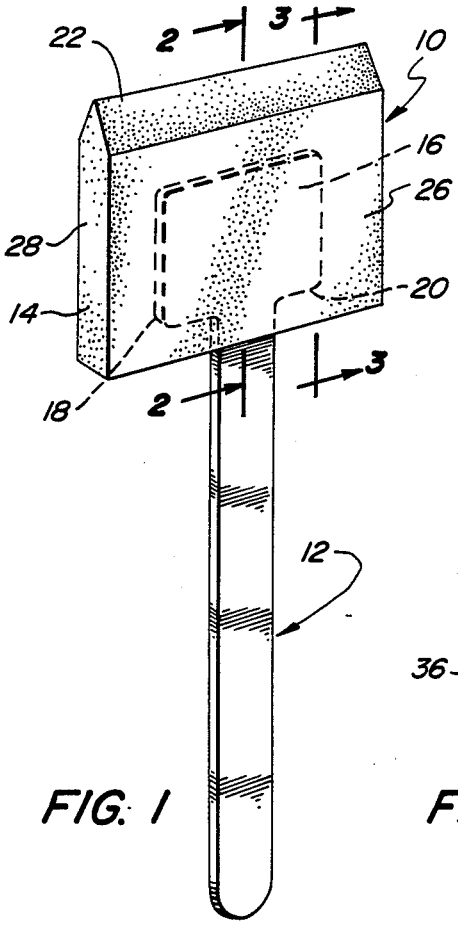
FIG. 1 is a perspective view of the present invention showing the lotion pad mounted to the proximate end of the handle.

Referring more particularly to FIG. 1, there is shown in overall perspective view of the preferred embodiment of the present invention which defines a sun-tan lotion applicator, generally indicated at 10, comprising a suitable elongated handle 12 which can be of any suitable configuration formed from a high-impact plastic material. The handle is provided with a length that will suitably reach any part of the user's body with ease. That is, it will allow the sponge-like pad member 14, when secured to the proximate end of handle 12, to make a rubbing contact with the skin of the user thereof, Thus, lotion absorbed in the pad is easily released over all areas of one's body.

Figure 2:
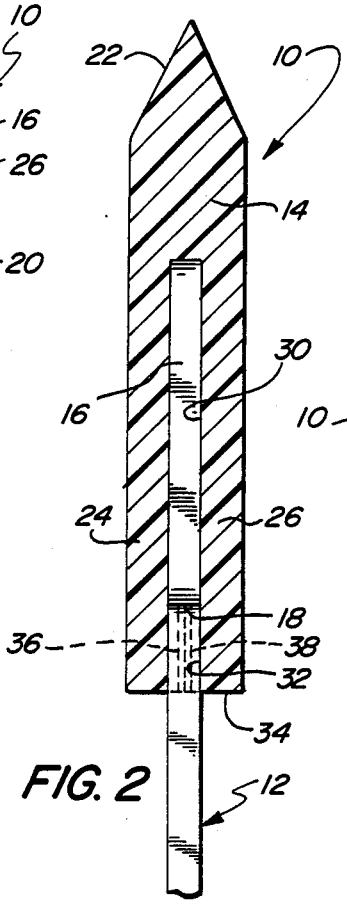
FIG. 2 is an enlarged cross-sectional view taken substantially along line 2—2 of FIG. 1, wherein the head portion of the handle is shown in elevation.

The configuration of handle 12 includes a paddle or head member 16 formed at the pad securing end thereof and is illustrated in FIGS. 1 and 2 as having a substantially square or rectangular configuration defining a pair of laterally extended shoulder members 18 and 20. These shoulders aid in the securing of handle 12 within applicator pad 14.

Figure 3:
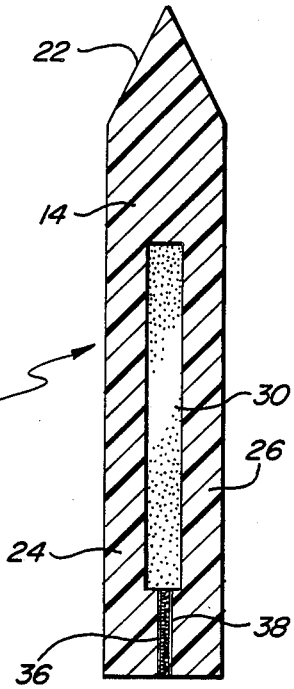
FIG. 3 is a similar cross-section to that of FIG. 2, but is taken substantially along line 3—3 of FIG. 1, wherein the internal cavity without the handle is illustrated but includes a securing device disposed within the lower slot of the pad.
Figure 4:
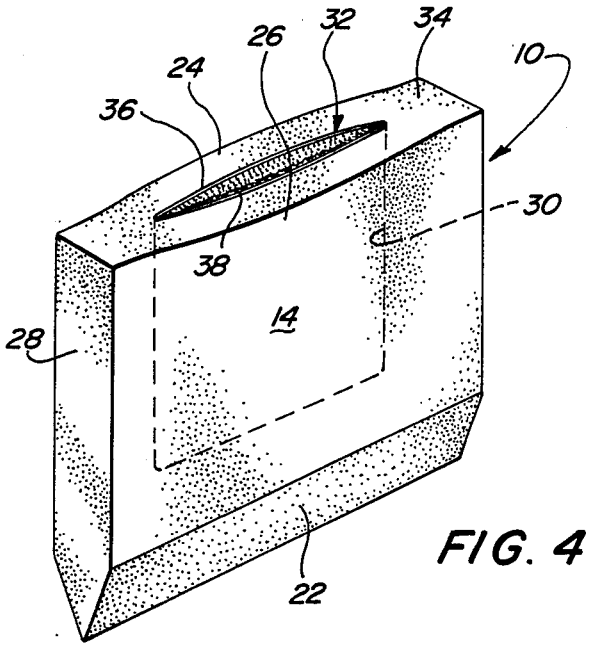
FIG. 4 is a prespective view of the sponge pad looking at the slotted bottom thereof in an open position.

Applicator pad 14 is also shown as having a substantially rectangular configuration with the upper leading edge thereof being formed having a wedged shape, as indicated at 22. However, it should be noted that the overall outer shape of applicator pad 14 can be of a any suitable configuration including a circular form, which is not shown herein. Pad 14, includes contact walls 24 and 26 and end walls 28 which define an internal cavity 30 preferably formed having the same configuration as paddle or head member 16, whereby said head member will fit snugly within cavity 30, as seen in FIG. 2. Internal cavity 30 is provided with a mouth 32 defined by a slot formed longitudinally along the bottom wall 34. Mouth 32 is wide enough to allow paddle 16 to enter cavity 30 and close about the handle just below shoulders 18 and 20 thereof. A securing means is arranged within mouth 32 to prevent applicator pad 14 from being accidentally removed from handle 12. Accordingly, the securing means may be provided in several different arrangements, but the preferred arrangement thereof is shown in FIGS. 3 and 4, wherein coupling fabric members are mounted to the inner lips of mouth 32. Such fabric material comprises a first strip 36 having very small looped members that are oppositely disposed to a second strip 38 which is provided with matching hook members. When positioned in an open mode as illustrated in FIG. 4, paddle 16 is readily inserted or removed from cavity 30 as needed. In FIGS. 2 and 3 the securing strips 36 and 38 are in a closed locking mode. After paddle member 16 is inserted into cavity 30 the strips are pressed together and the areas under shoulders 18 and 20 are locked closed, whereby shoulders 18 and 20 engage the closed portion of mouth 32. This also allows pad 14 to be removed for cleaning or for replacement by another applicator pad, when necessary.

Figure 5:
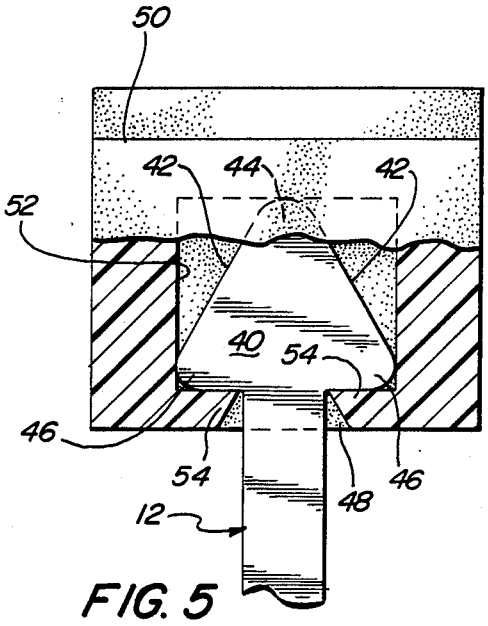
FIG. 5 is a slide elevational view of an alternative arrangement of the present invention with a portion of the pad wall being broken away.

Referring more particularly now to FIG. 5, there is shown another embodiment of the present invention wherein handle 12 is formed having a rectangular head member 40. Inclined side members 42 of head member 40 are defined by apex portions 44 and the oppositely positioned shoulder member 46. This shape provides two results, one being that head 40 is adapted to be readily inserted through the restricted mouth 48 of liquid-absorbent pad or applicator 50, and the other being that mouth 48 is defined by a slot having a substantially smaller width opening than that of the width of the base of head member 40 so as to communicate with inner cavity 52, thus there is forming therebetween arm members 54. Since, applicator pad 50 is formed from a sponge-like rubber material, head 40 is readily pushed past arm members 54 whereby the arm members will engage under shoulder member 46, thereby establishing suitable securing means to prevent inadvertent separation of pad 50 from handle 12. Again as before, pad 50 can be readily removed when required by manually pulling the pad from engagement with head 40.

It may be thus seen that the objects of the present invention set forth herein, as well as those made apparent from the foregoing description are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A device for applying suntan lotion and like liquids to one's body wherein the device comprises:

an elongated handle having a head member formed on the proximate end thereof;

a sponge-like applicator pad having an interior cavity with an open-end mouth portion whereby said head member of said handle is allowed to pass therethrough so as to be positioned in said interior cavity;

means for removably securing said applicator pad to said head member located within said mouth portion of said applicator, wherein said securing means comprises:

a first securing member attached to one side of said mouth, wherein said first securing member is formed having a multiplicity of looped members; and a second securing member attached to the other side of said mouth, wherein said second securing member is formed having a multiplicity of hook members for locking engagement with said looped members of said fiist securing member, whereby said head of said handle is prevented from passing through said mouth, and wherein said head member is provided with oppositely positioned shoulder members which extend longitudinally outward from the sides of said handle, whereby said shoulder members engage said securing members to prevent inadvertent separation of said applicator pad from said head member.

2. A device as recited in claim 1, wherein said applicator pad is formed having an elongated tapered upper leading edge.

3. A device as recited in claim 2, wherein said interior cavity is formed having a substantially square configuration.

4. A device as recited in claim 3, wherein said applicator pad is provided with a substantially square configuration.

5. A device as recited in claim 3, wherein said securing means comprises a pair of oppositely positioned arm members which help to define said mouth of said interior cavity.

6. A device as recited in claim 5, wherein said head member of said handle is formed having a triangular configuration having an apex and a base, wherein said base defines shoulder members positioned for engagement with respective arm members.

7. A device as recited in claim 6, wherein the width of said base of said head member is greater than the width of said mouth of said applicator pad.

* * * * *